US006030014A

United States Patent [19]

Vaillancourt et al.

[11] Patent Number: 6,030,014

[45] Date of Patent: Feb. 29, 2000

[54] ALIGNMENT LIFTING FIXTURE

[75] Inventors: John J. Vaillancourt, Tiverton; Steven L. Camara, Riverside; Daniel W. French, Portsmouth, all of R.I.

[73] Assignee: The United States of America as represented by the Secretary of the Navy, Washington, D.C.

[21] Appl. No.: 09/152,475

[22] Filed: Sep. 11, 1998

[51] Int. Cl.[7] ..... B63C 7/16

[52] U.S. Cl. ..... 294/68.1; 294/66.1

[58] Field of Search ..... 294/68.1, 68.3, 294/67.1, 67.3, 66.1, 66.2, 81.41, 68.25; 206/501, 503, 509, 511, 512; 403/13, 14

[56] References Cited

U.S. PATENT DOCUMENTS

| | | | |
|---|---|---|---|
| 3,695,139 | 10/1972 | Howe | 85/33 |
| 3,752,511 | 8/1973 | Racy | 287/2 |
| 4,344,716 | 8/1982 | Sigal | 403/13 |
| 5,133,667 | 7/1992 | Daughtrey | 439/67 |

FOREIGN PATENT DOCUMENTS

| | | | |
|---|---|---|---|
| 1531283 | 12/1969 | Germany | 294/68.3 |

*Primary Examiner*—Robert P. Olszewski
*Assistant Examiner*—Paul Chin
*Attorney, Agent, or Firm*—Michael J. McGowan; James M. Kasischke; Prithvi C. Lall

[57] ABSTRACT

An aligning and lifting device is disclosed. The invention may be for use with an underwater cage including a top portion and a bottom portion. The aligning and lifting device includes a male member having a support surface fixed to the top portion of the cage, an integrally formed wedge shaped portion depending from the support surface for lateral alignment capabilities, and an alignment pin projecting from the distal end of the depending wedge shaped portion for facilitating vertical alignment. The device also has a female member that includes integrally formed side walls and complementary support surfaces opposed to the support surface of the male member, thereby defining a complementary wedge shaped opening for receiving the depending wedge portion of the male member. An alignment pin hole is formed at the base of said complementary wedge shaped opening for receiving the alignment pin of the depending wedge. The male member is aligned with the female member in a vertical direction by insertion of the alignment pin into the alignment pin hole and in a lateral direction by mating of the male wedge with the complementary shaped female opening.

11 Claims, 3 Drawing Sheets

ALIGNMENT LIFTING FIXTURE

STATEMENT OF GOVERNMENT INTEREST

The invention described herein may be manufactured and used by or for the government of the United States of America for governmental purposes without the payment of any royalties thereon or therefor.

BACKGROUND OF THE INVENTION

1. Field of the Invention

This invention generally relates to a device for aligning and lifting underwater objects.

2. Description of the Prior Art

Earlier methods for aligning and lifting of underwater objects were time consuming and difficult to engage.

The following patents, for example, disclose aligning and/or lifting devices, but do not disclose aligning in both vertical and lateral directions in order to mate two halves of a heavy object to lift the same.

U.S. Pat. No. 3,045,785 to Ferguson

U.S. Pat. No. 4,899,611 to Pinna

U.S. Pat. No. 5,007,760 to Mullen et al.

U.S. Pat. No. 5,085,535 to Solberg et al.

U.S. Pat. No. 5,412,913 to Daniels et al.

Specifically, the patent to Ferguson discloses a device for connecting parts together, utilizing a side beam "A" and a bottom ring segment "B". The side beam includes a tapered tongue 10 which is insertable into a mating slot or channel 12 of the bottom ring segment. A captive taper pin 20 is inserted into longitudinal apertures formed in each of the tapered tongue 10 and the bottom ring segment "B". This captive taper pin is in effect the only aligning device used in the Ferguson patent and must accomplish both vertical and lateral alignment. In other words, it is necessary to use a specialized pin 20 and varying sized apertures in the side beam and the bottom ring segment in order to both vertically and horizontally align the two parts.

The patent to Pinna discloses a device for the correct positioning of the lower steering shaft on the steering box pinion and on the upper shaft, but does not utilize both vertical and lateral alignment features.

Regarding the patent to Mullen et al., there is disclosed a device for aligning and mounting a copier or printer subsystem. The mounting and aligning, however, is only in a single direction, with a memory feature to retain the obtained alignment.

The patent to Solberg et al. discloses a locating mechanism which has two mating surfaces cooperating for radial and axial alignment to form on engagement an open-ended cylindrical body having opposed cylindrical surfaces and opposed marginal surfaces. The Solberg et al. device is unforgiving in that simultaneous axial and radial alignment is required in order for registry of opposing surfaces to occur. In an underwater environment, such exactness is not possible.

The patent to Daniels et al. is directed to a self aligning beam joint suited or use in modular construction and requires exact manual vertical alignment in order to secure the upper and lower columns together. Such an arrangement would be impossible given the heavy weight of an underwater cage of the present invention.

It should be understood that the present invention would in fact enhance the functionality of the above patents.

SUMMARY OF THE INVENTION

Therefore it is an object of this invention to provide an alignment and lifting device which is an improvement over known alignment devices found in the art.

Another object of this invention is to provide an alignment and lifting device which mates an upper member with a lower member in both vertical and lateral directions.

Still another object of this invention is to provide an alignment and lifting device which enables lateral alignment of the members.

A still further object of the invention is to provide an alignment and lifting device which facilitates vertical or axial alignment of the members.

Yet another object of this invention is to provide an alignment and lifting device which is applicable to an underwater unmanned swim out cage.

In accordance with one aspect of this invention, there is provided an aligning and lifting device for an unmanned underwater cage. The underwater cage includes a top portion and a bottom portion. The aligning and lifting device includes a male member having a support surface fixed to the top portion of the cage, an integrally formed wedge shaped portion depending from the support surface for lateral alignment capabilities, and an alignment pin projecting from the distal end of the depending wedge shaped portion for facilitating vertical alignment. The female member includes integrally formed side walls and a support surface opposed to the support surface of the male member, thereby defining a complementary wedge shaped opening for receiving the depending wedge portion of the male member, and an alignment pin hole for receiving the alignment pin of the depending wedge. The support surface of the female member is fixed to the bottom portion of the cage. The male member is aligned with the female member in a vertical direction by insertion of the alignment pin into the alignment pin hole and in a lateral direction by mating of the male wedge with the complementary shaped female opening. Complete lateral and vertical mating of the male member with the female member forms a unitary block. Additionally, the male member is secured to the female member upon mating thereof, and securing of the male member to the female member correspondingly secures the top portion of the cage to the bottom portion of the cage for unitary lifting of the entire cage structure.

The present invention uses separate features to accomplish each of the vertical and lateral alignments. The cost of the present invention is also far less because it allows use of a quick connect pin instead of a more expensive taper pin and the apertures of the present invention are of a uniform diameter as opposed to being varied. This can all be achieved by providing the addition of a vertical alignment pin and corresponding alignment pin hole as shown in the present invention. Therefore, the present invention can in fact be considered a substantial improvement over the prior art.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
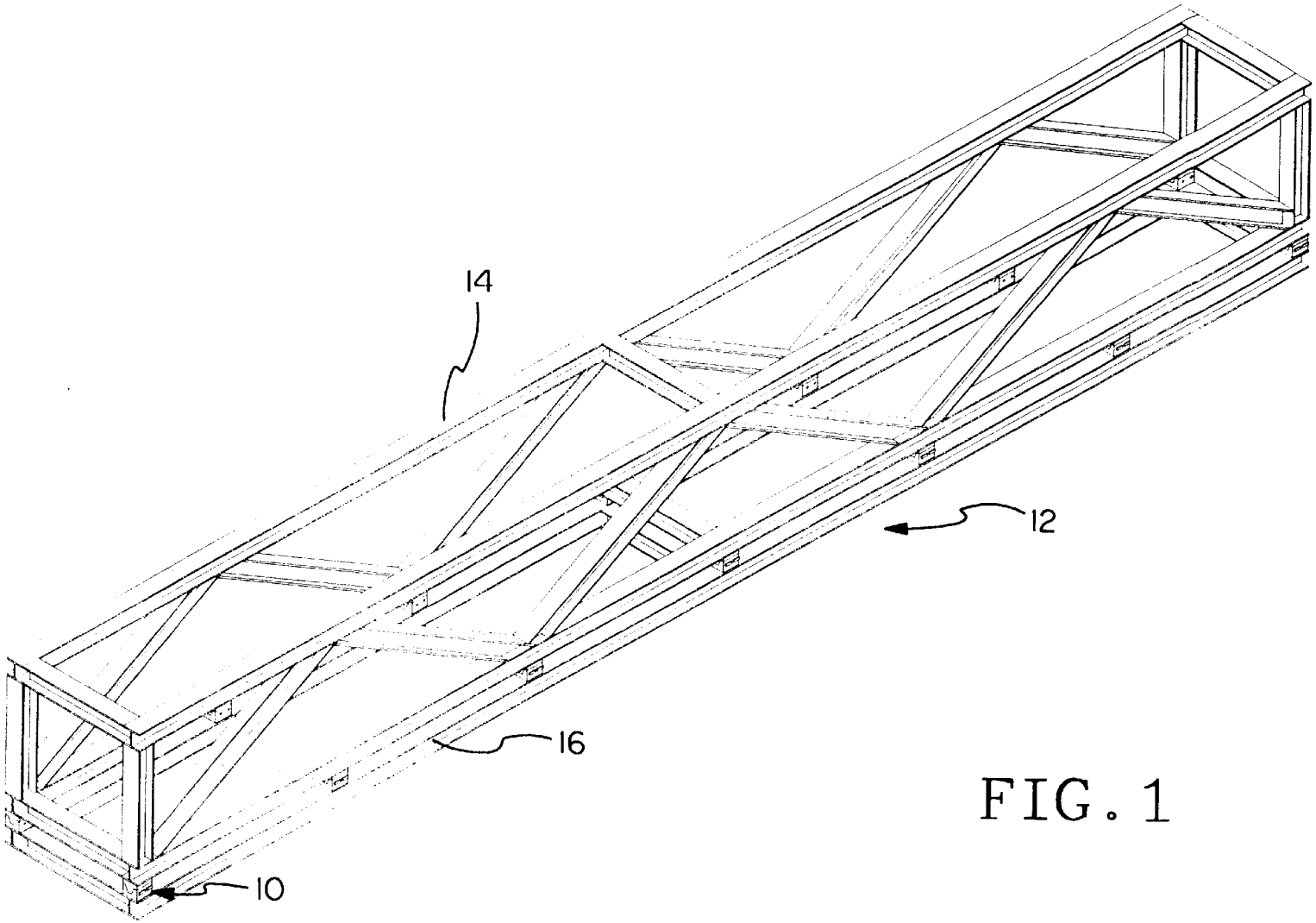
FIG. 1 is a front perspective view of an underwater cage utilizing the aligning device of the present invention.

Referring now to the figures, FIG. 1 illustrates a perspective view of an unmanned underwater vehicle swim out cage 12 having an aligning and lifting device 10 applied thereto. The cage 12 is shown without the vehicle for the sake of clarity. There are two primary parts to the underwater cage 12, including a top half 14 and a bottom half 16 of the cage 12. When lifting or moving the cage 12, it is necessary to align the top half 14 with the bottom half 16 thereof.

Figure 2:
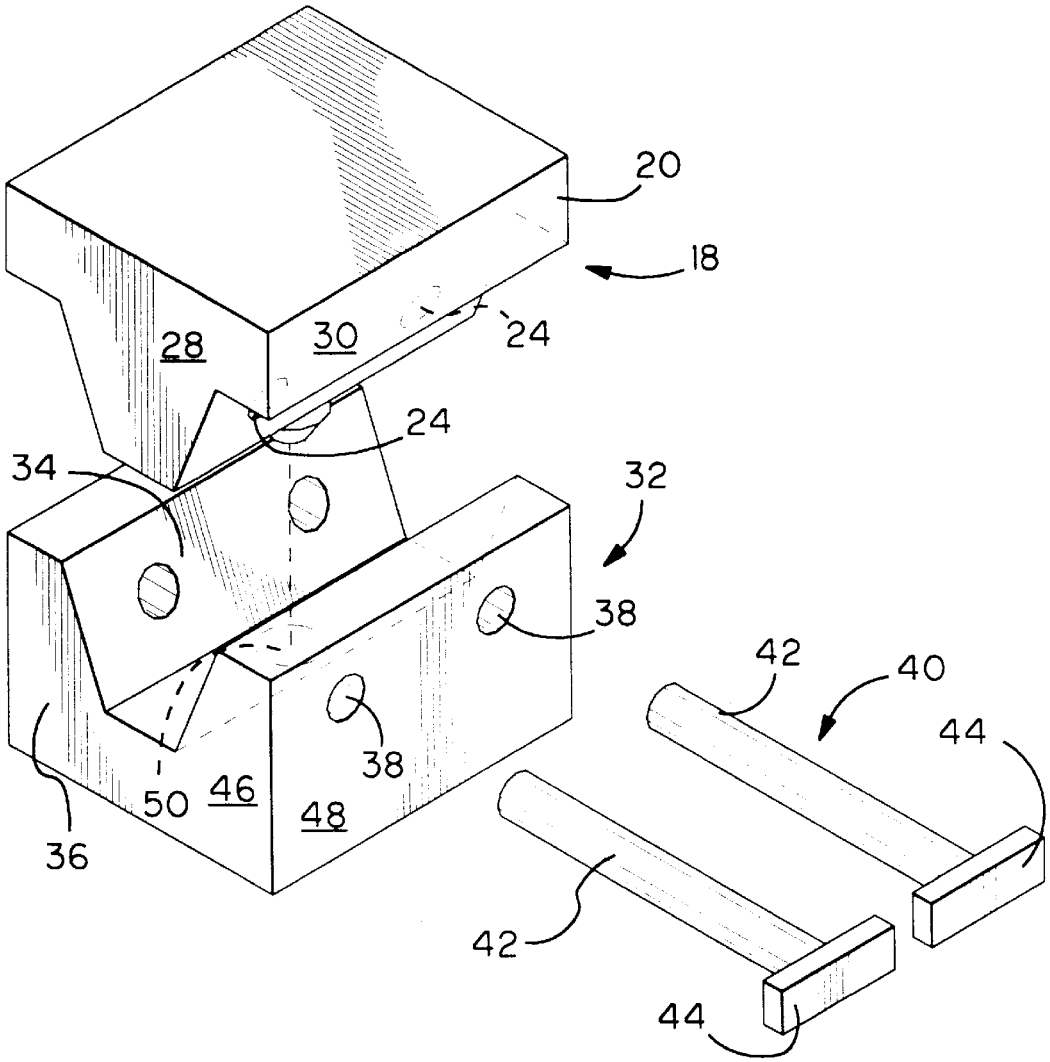
FIG. 2 is a front perspective view of an underwater cage utilizing the aligning device of the present invention.
Figure 4:
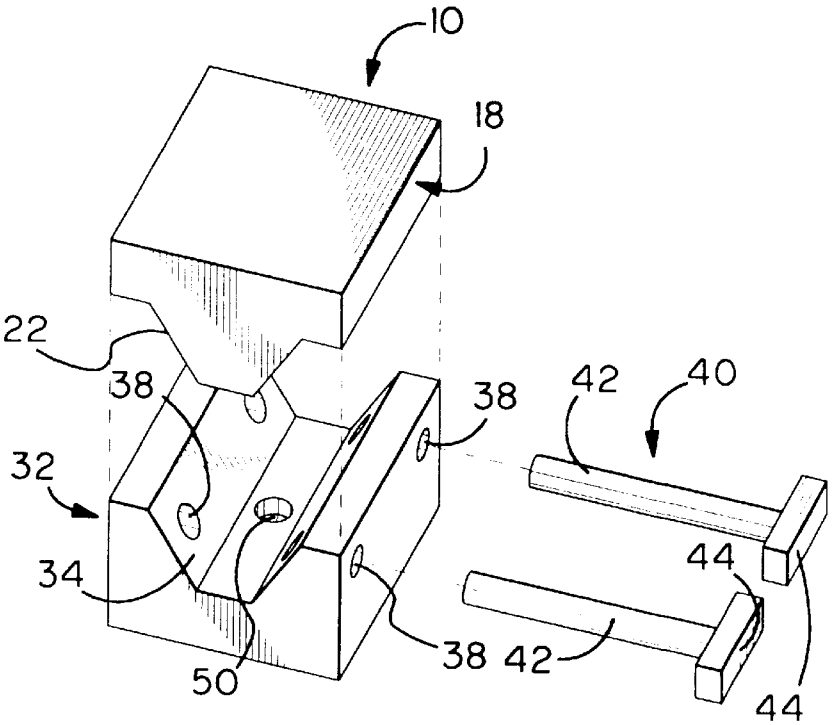
FIG. 4 is a bottom and side perspective and exploded view of the lifting device shown in FIG. 1.
Figure 3:
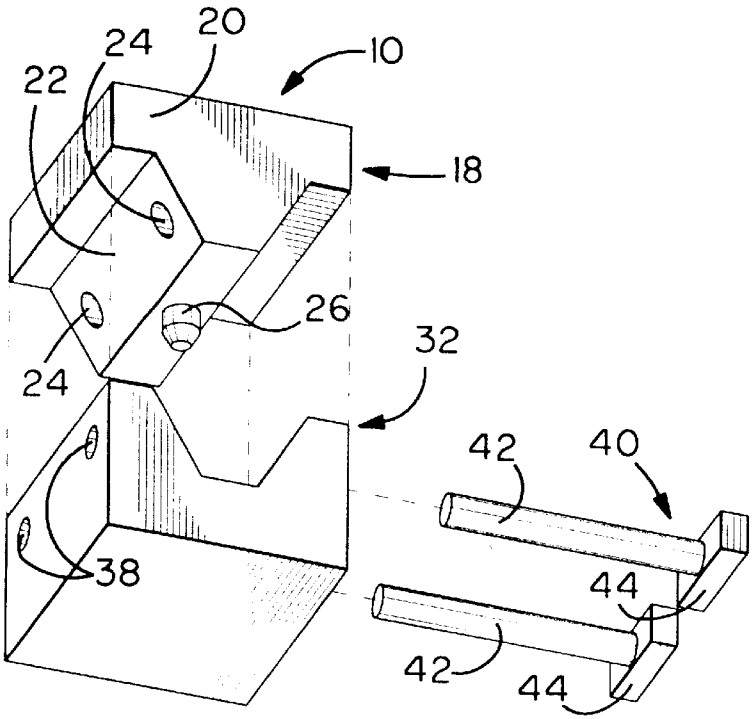
FIG. 3 is a front perspective and exploded view of the lifting device shown in FIG. 1.

As shown in greater detail in FIGS. 2, 3 and 4, the aligning and lifting device 10 is used to align the top half 14 with the bottom half 16 of the cage. In general, the aligning and lifting device 10 includes two stainless steel blocks and two quick release pins which align and lift the two halves of the unmanned underwater vehicle swim out cage with the vehicle in the cage. More specifically, the alignment and lifting device 10 includes an upper portion 18 and a lower portion 32. The upper portion 18 includes a primary block member 20 and a wedge shaped portion 22 depending from the primary block member 20. As shown, and for purposes of reference, the upper portion 18 of the alignment and lifting device 10 has facing walls 28 and end walls 30. The end walls 30 are oriented substantially perpendicularly to the facing walls 28. At least a pair of wedge apertures 24 are formed in the wedge shaped portion 22 of the alignment and lifting device 10. More specifically, the wedge apertures 24 are formed in a wall of the wedge portion corresponding to the end walls 30, and are thus perpendicular to the facing walls 28. Each of the wedge apertures 24 is formed through the entirety of the wedge portion 22.

An axial alignment pin 26 is formed to depend from a terminal end of the wedge shaped portion 22 as shown. It is intended that the term axial refer to what is the vertical orientation of the device 10. The axial alignment pin 26 in combination with the axial alignment pin hole 50 accounts for the vertical mating of the upper 14 and lower 16 cage portions with each other.

The lower portion 32 of the alignment and lifting device 10 includes a U-shaped body member 36 having a wedge receiving portion 34 defined thereby which is shaped to conform to and snugly receive the wedge portion 22. The U-shaped body member 36 includes a facing wall 46 and end walls 48. Upon mating of the upper portion 18 and the lower portion 20, it will be appreciated that the alignment and lifting device appears as simple block shape. At least a pair of longitudinal apertures 38 are formed in the facing walls 46 of the U-shaped body member 36. These longitudinal apertures 38 are aligned with the longitudinal wedge apertures 24 of the upper portion 18 upon mating of the upper 18 and lower 32 portions of the alignment and lifting device. An axial alignment pin hole 50 is formed in the base of the wedge receiving portion 34 of the U-shaped body member 36 and is complementary in shape to the axial alignment pin 26.

Upon joining of the upper portion 18 with the lower portion 32 of the alignment and lifting device 10, the wedge apertures 22 will be precisely aligned with the longitudinal apertures 38 in the U-shaped body member 36. This precise alignment is due to the complementary mating shapes of the wedge portion 22 with the wedge receiving portion 34. In other words, the complementary shapes of these two members permits only one longitudinal mating possibility. With the axial (vertical) alignment being accounted for by the mating of the axial alignment pin 26 with the axial alignment pin hole 50 and the lateral alignment accounted for by the wedge matching, both the vertical and lateral positioning of the upper 18 and lower 32 portions are virtually self-aligning.

In order to secure the upper 18 and lower 32 portions of the alignment and lifting device 10 together, at least a pair of longitudinal quick release pins 40 are inserted into the aligned openings of the wedge apertures 24 and the longitudinal apertures 38 in the U-shaped portion 36. Each longitudinal alignment pin 40 includes a shaft or shank portion 42 and a head portion 44 as shown. Since the apertures 24 and 38 are on a common axis, the insertion of the longitudinal alignment pins 40 is a simple matter.

Each of the upper portion 18 and the lower portion 32 of the alignment lifting device 10 is secured to the top half 14 and bottom half 16, respectively, of the swim out cage 12 at a plurality of locations on the cage 12. The securing may be by any suitable means such as, for example, welding or bolting. In some instances, it may be possible for the upper 18 and lower 32 portions of the alignment and lifting device to be integrally formed with the respective parts of the cage 12 during the cage forming process. In any event, it should be understood that the securing means will be suitable to the weight of the cage with a vehicle in the cage 12, so that lifting of the cage will not cause separation of the alignment and lifting device 10 from the cage 12. As shown in FIG. 1 there are 14 alignment and lifting devices 10 shown to be periodically spaced around the cage 12. The number of alignment and lifting devices used is not significant except that they should be sufficient in number to adequately support the load within the cage 12 and to evenly secure the top part 14 of the cage to the bottom part 16 of the cage.

With regard to the use of the wedge shaped portion 22 and its complementary wedge receiving portion 34, it should be understood that this arrangement was selected for the unique ability to align in both the axial and lateral directions when mating the top part 14 of the cage 12 to the bottom part 16 of the cage 12. However, it may be found that other shapes are suitable for the dual axis positioning of large objects, and the present invention is intended to encompass those shapes as well. Similarly, although the use of pair of apertures 22, 38 and pins 40 are shown, any number of apertures and corresponding number of pins may be found to be suitable. Further, although a simple straight pin 40 is shown, any type of quick disconnect pin would be suitable which will slide through the common axis of the apertures.

By the present invention, the aligning and lifting of a heavy object such as a swim out cage 12 is conducted in a timely and more efficient manner than previously achieved in the art. The entirety of the inventive alignment and lifting device 10 when assembled as a block is 3½ inches wide by 4 inches long and 3½ inches high and made out of stainless steel. The pins 40 are 0.500 inch diameter stainless steel, but also may be made of any other suitable material.

The invention shown has been sized for a particular application of aligning cage parts that are 25 feet long and 3 feet high, with a loaded weight of 20,000 pounds. Accordingly, and as previously mentioned, varying the size of the blocks or the pins can be done for different applications. Likewise, the design may be further modified by changing the composition of the materials used or by changing the number of alignment and lifting blocks used. It should also be appreciated that the disclosed alignment and lifting blocks 10, while being shown for use in a heavy unmanned water vehicle swim out cage 12, may be used for aligning and lifting virtually any heavy, two part, symmetrical object, either on land or under water.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An alignment and lifting device comprising:

a male member including an integrally formed wedge shaped depending portion, said male member wedge portion having at least one aperture formed therein;

a female member opposed to said male member and including integrally formed side walls and a wedge support surface positioned between said side walls defining a complementary shaped opening for receiving the wedged shaped depending portion of said male member, wherein engagement of said depending portion of said male member with the side walls of said female member laterally aligns said male member with respect to said female member, said side walls of said female member having apertures formed therein, such that upon mating of said male member with said female member, said male member wedge portion apertures are axially aligned with said side wall apertures;

an alignment pin projecting from the distal end of the wedge shaped depending portion of said male member, said female member having an alignment pin hole formed in an inner face of said wedge support surface thereof for receiving said alignment pin, wherein vertical seating of said male member within said female member and insertion of said projecting pin into said alignment pin hole aligns said male member with respect to said female member, wherein complete lateral and vertical mating of said male member with said female member forms a unitary block; and at least one pin member for insertion into said axially aligned apertures for securing said male member to said female member.

2. The device according to claim 4, wherein said male member further includes a male member support surface from which said wedge shaped depending portion extends, said female member having complementary support surfaces on said side walls.

3. The device according to claim 2, wherein said male member support surface is a horizontal surface, and said complementary support surfaces are also horizontal surfaces.

4. The device according to claim 1, wherein said at least one pin member is a quick release pin.

5. The device according to claim 1, wherein said at least one pin member includes a shaft and a head at one end of said shaft.

6. An underwater structure comprising:

an unmanned underwater cage having a top portion and a bottom portion;

a male member including an integrally formed wedge shaped depending portion fixed to the top portion of said cage;

a female member opposed to said male member and including integrally formed side walls and a wedge support surface positioned between said side walls defining a complementary shaped opening for receiving the wedge shaped depending portion of said male member, said support surface being fixed to the bottom portion of said cage, wherein engagement of said depending portion of said male member with the side walls of said female member laterally aligns said male member with respect to said female member;

an alignment pin projecting from the distal end of the wedge shaped depending portion of said male member, said female member having an alignment pin hole formed in an inner face of said wedge support surface thereof for receiving said alignment pin, wherein vertical seating of said male member within said female member and insertion of said projecting pin into said alignment pin hole singularly aligns said male member with respect to said female member, wherein complete lateral and vertical mating of said male member with said female member forms a unitary block; and means for securing said male member to said female member upon mating thereof, wherein securing of said male member to said female member correspondingly secures the top portion of said cage to the bottom portion of said cage for unitary lifting of the entire cage structure.

7. The device according to claim 6, wherein said male member further includes a male member support surface from which said wedge shaped depending portion extends, said female member having complementary support surfaces on said side walls.

8. The device according to claim 7, wherein said male member support surface is horizontal surface, and said complementary support surfaces are also horizontal.

9. The device according to claim 6, wherein said means for securing said male member to said female member comprises:

said male member wedge portion having at least one aperture formed therein;

said side walls of said female member having apertures formed therein, such that upon mating of said male member with said female member, said male member wedge portion apertures are axially aligned with said side wall apertures; and at least one pin member for insertion into said axially aligned apertures for securing said male member to said female member.

10. The device according to claim 9, wherein said at least one pin member is a quick release pin.

11. The device according to claim 9, wherein said at least one pin member includes a shaft and a head at one end of said shaft.

* * * * *